United States Patent [19]

Dickens et al.

[11] 4,241,555

[45] Dec. 30, 1980

[54] COMPOSITE PANEL STRUCTURE AND METHOD OF MANUFACTURE

[75] Inventors: Luther I. Dickens, Radford, Va.; William C. Nanny, San Francisco, Calif.

[73] Assignee: Radva Plastics Corporation, Radford, Va.

[21] Appl. No.: 910,762

[22] Filed: May 30, 1978

Related U.S. Application Data

[63] Continuation of Ser. No. 659,758, Feb. 20, 1976, abandoned.

[51] Int. Cl.[2] ..... E04C 2/18; E04C 2/26

[52] U.S. Cl. ..... 52/454; 52/309.4; 52/309.7; 52/592

[58] Field of Search ..... 52/309.4, 309.7, 309.8, 52/592, 601, 454; 428/310

[56] References Cited

U.S. PATENT DOCUMENTS 2,957,483 10/1960 Dunn ..... 52/309.4

FOREIGN PATENT DOCUMENTS 1443172 5/1966 France ..... 52/309.4

*Primary Examiner*—John E. Murtagh

*Attorney, Agent, or Firm*—Alvin E. Hendricson

[57] ABSTRACT

A building panel has an expanded plastic core with thin reinforcing strips bonded to front and back surfaces of the core, at least along the edges thereof, and may have a wire grid attached in offset relation to one surface thereof for receiving a material such as concrete. The panel is manufactured by a process of expanding a plastic material in a mold by the application of heat to form a core, removing the core from the mold, placing thin reinforcing strips on front and back surfaces of the core with an adhesive system between strips and core, returning the core to the mold and heating the interior of the mold to bond the strips to the core and achieve dimensional stability during molding.

5 Claims, 15 Drawing Figures

COMPOSITE PANEL STRUCTURE AND METHOD OF MANUFACTURE

This is a continuation of application Ser. No. 659,758, filed Feb. 20, 1976, now abandoned.

BACKGROUND OF INVENTION

There have been developed a wide variety of prefabricated panels or the like for multiple uses including building structures. One eminently successful type of prefabricated panel is plywood. There have also been developed a variety of sandwich structures having, for example, a honeycomb core.

In the construction of buildings various types of preformed panels have been employed and in the field of concrete buildings it is known, for example, to pour large concrete panels which generally have reinforcing steel therein and may have other materials such as insulation included therein, for use as walls, floors and the like.

The present invention comprises a panel having an expanded plastic core of sheet-like configuration with thin reinforcing strips bonded to front and back surfaces thereof, at least along the edges of the core. This panel has a variety of uses and may be particularly advantageously employed by attaching a wire mesh to one surface in spaced relation thereto for receiving concrete. Panels in accordance with the present invention may be joined together to form a desired shape or structure and, with the above-noted wire mesh on the outer surface thereof, concrete may then be applied to produce a structurally sound building or the like wherein the panels of the present invention form an integral part thereof.

SUMMARY OF INVENTION

The composite panel of the present invention is comprised as an expanded plastic core such as expanded polystyrene. The physical configuration of the core may vary according to the application of the panel and thus, for example, may be planar, curved in one direction, or curved in two opposite directions. The core is expanded in a mold so that it is possible to make substantially any desired panel configuration. The molded sheet of expanded plastic or core of the panel has thin reinforcing strips bonded to opposite major surfaces thereof, i.e., the front and back of the panel have strips thereon. These strips extend along the edges of the surfaces and additional strips may be provided across the surfaces. The reinforcing strips preferably extend from two sides of the front surface of each panel in order to overlap the surfaces of adjacent panels for attachment of panels together. This attachment may be simply accomplished by the use of sheet metal screws or the like extending through the overlapping strips of contiguous panels.

When the panels of the present invention are employed in building structures, it is advantageous to form the panels with a curvature, and preferably a double curvature, so that panels of different shapes may be assembled to form spherical or semi-spherical surfaces to support a maximum exterior load. For such application the individual panels are provided with a wire mesh on the exterior surface of each and such mesh is mounted upon the panel in spaced relation thereto. Such a panel structure, and particularly a plurality of assembled panel structures, is admirably adapted to receive and retain a layer of concrete applied to the exterior surfaces thereof. The wire mesh forms reinforcing rod or wire in the concrete. Upon hardening of the concrete there is formed an integral wall structure including the panels of the present invention which may be treated on the interior surface thereof as desired and such a wall structure has extremely good insulating property substantially in excess of that available from conventional construction.

The method of manufacture of the present invention is rapid, efficient and insures the dimensional stability of the panels. Panel cores are formed by an expanding plastic, such as polystyrene, in a mold through the application of heat. It is known that expanded plastic, such as expanded polystyrene, shrinks upon removal from a mold; however, the present invention overcomes this difficulty. The expanded plastic core is removed from the mold and thin reinforcing strips of metal, wood or plastic are placed on the front and back surfaces of the core and the core returned to the mold. These strips are placed at least along the edges of the core surfaces. An adhesive system is employed to bond the strips to the core through the application of heat and the adhesive may be applied to the strips prior to their insertion in the mold. Heat is then again applied to the mold interior to actuate the adhesive system and this also serves to re-expand the plastic core to the edges of the mold. This re-expanded plastic bonds to the thin strips which then prevents the expanded plastic from shrinking when the panel is removed from the mold and cooled.

DESCRIPTION OF FIGURES

The present invention is illustrated as to a particular preferred embodiment and steps of the method of manufacture in the accompanying drawings wherein.

DESCRIPTION OF PREFERRED EMBODIMENT

Figure 1:
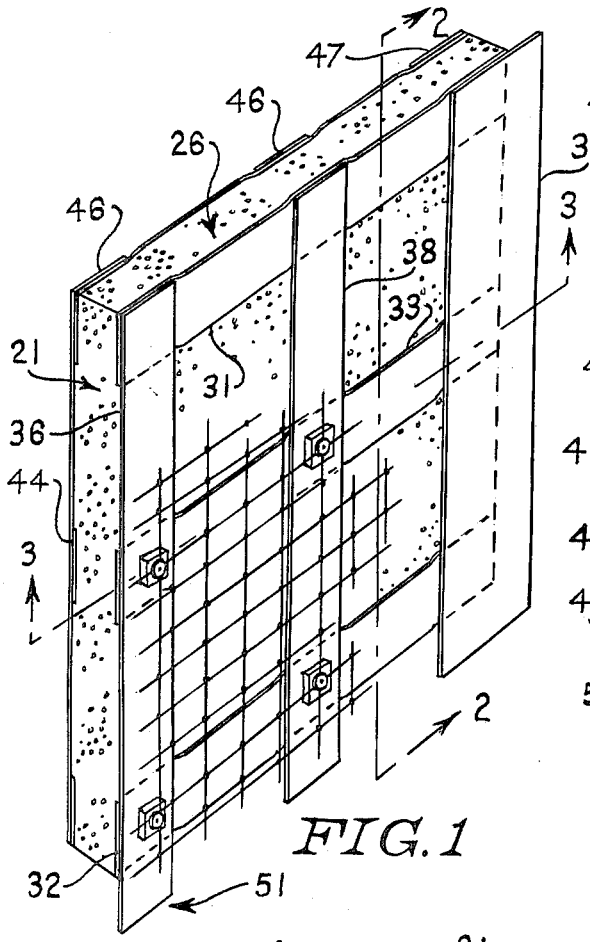
FIG. 1 is a perspective view of a panel formed in accordance with the present invention.
Figure 2:
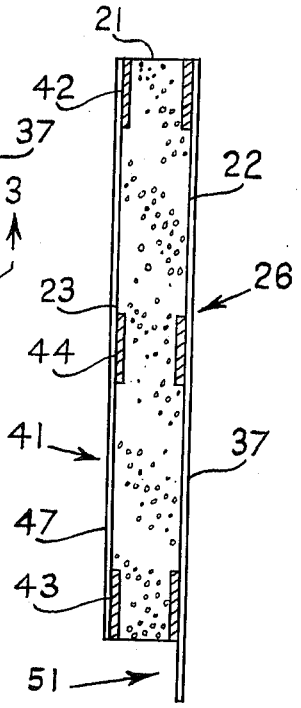
FIG. 2 is a sectional view taken in the plane 2—2 of FIG. 1 and excluding the wire mesh.
Figure 3:
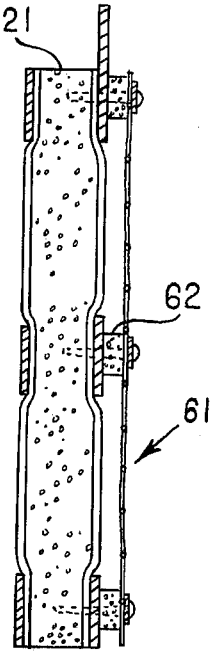
FIG. 3 is a sectional view taken in the plane 3—3 of FIG. 1 and including the wire mesh attached to the panel.

The present invention as illustrated at FIGS. 1 to 3, for example, is comprised as a core 21 of an expanded plastic material, such as expanded polystyrene. The shape of the core 21 determines the shape of the panel and clearly variations are possible; however, in general the core has a substantially flat sheet-like configuration with front and back surfaces 22 and 23, respectively. The panel of the present invention may be curved or planar and the embodiment illustrated in FIGS. 1 to 3 is a planar panel. In the following description the core 21 is considered to be substantially flat to distinguish the shape thereof from cylindrical, spherical, or the like, even though it is realized that the panel may actually be curved, as further described below.

The panel core 21 is formed of a lightweight moldable material having good insulating properties and at least a limited structural rigidity so that the core is, in fact, substantially rigid. The core is preferably formed of an expanded plastic such as expanded polystyrene, polyethylene or polyurethane of a density to provide good thermal insulation and structural strength. For example, the core may be formed of an expanded polystyrene having a density of the order of one pound per cubic foot to six pounds per cubic foot and a density of two pounds per cubic foot has been found to provide very good thermal and physical properties.

Upon the front surface 22 of the core there is disposed a plurality of thin reinforcing strips 26 including at least horizontal strips 31 and 32 disposed along the top and bottom edges of the front surface and vertical strips 36 and 37 disposed along the side edges of the front surface. Additional strips are preferably provided, as indicated by the centrally located horizontal strip 33 and the centrally located vertical strip 38. Upon the rear surface 23 of the core there are similarly provided thin reinforcing strips 41 including at least horizontal strips 42 and 43 on the top and bottom edges and vertical strips 46 and 47 along the vertical edges. In the illustrated embodiment of the invention there are also provided centrally located horizontal and vertical strips 44 and 46, respectively, upon the back surface of the core, preferably in alignment with similar front strips. These reinforcing strips may be formed of metal, wood or plastic.

The thin reinforcing strips described above are bonded to the core, preferably by the use of an adhesive system, as further described below. It is possible to physically attach the strips to the core by embedding the strips in part in the core or having portions of the core extending over parts of the strips and, of course, a variety of different types of adhesives may also be employed. It is, however, required that the thin reinforcing strips shall be firmly attached or bonded to the core surfaces at least around the edges of the front and rear surfaces. The reinforcing strips may, for example, be formed of a metal such as aluminum, tin-plated steel, or the like and need only have a minimal thickness such as 0.010 inch thick steel. The strips are, however, to have a sufficient width to adhere tightly to the core, although in the illustrations of FIGS. 1 to 3 the width of the strips is exaggerated. In practice a 4 ft.×6 ft. panel may, for example, have 3 inch wide strips. In the following description the strips are considered to be formed of metal.

In order to provide for attachment of panels together to form a wall or the like, the present invention provides for certain of the thin reinforcing strips on the front face of the panel to extend beyond the core. In the embodiment of the invention illustrated in the drawings hereof the vertical strips 36, 37 and 38 are elongated to depend from the bottom edge of the core so as to form metal tabs, as indicated at 51. Additionally, the vertical strip 37 on the front face of the panel is extended laterally outward from the right edge of the panel, as best illustrated in FIG. 1. Thus there are provided extensions of the strips along two edges of the front face of the panel for attachment of the panel to other structures, such as another panel. With the strips formed of metal and the side strip 37 overlapping a metal strip on a contiguous panel, sheet metal screws, for example, may be driven through these two strips to join the panels. It will also be noted that, with thin metal strips extending from the panel core as tabs 51, these tabs may be bent as desired. Thus the panel of FIG. 1 may be set upon a concrete slab, for example, with the tabs 51 bent outwardly at right angles to the front surface of the panel and concrete nails driven through these tabs into the concrete to fix the panel thereto.

Figure 4:
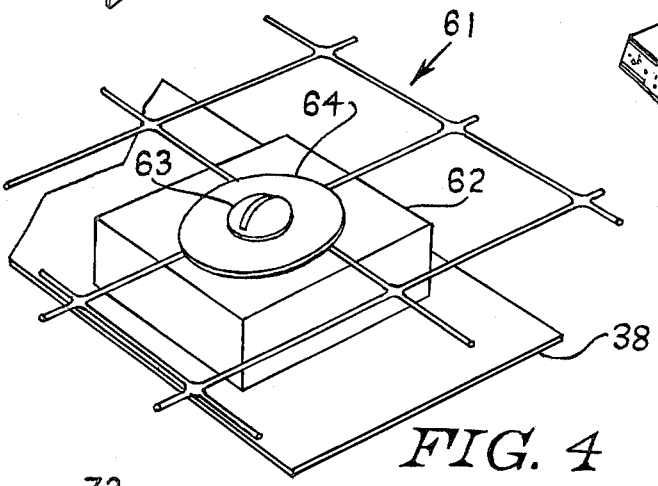
FIG. 4 is an enlarged partial view illustrating a means of attachment of wire mesh to the panel in spaced relation thereto.

The panel described above is a lightweight structural member which may be employed in a variety of ways; however, a particularly advantageous method of employing this panel is to attach a wire mesh 61 to the front face in offset or spaced relation thereto, as illustrated in FIGS. 1 and 3 of the drawings. This wire mesh 61 may be attached to the panel by placing small spacer blocks 62 on the metal strips and driving a sheet metal screw 63, for example, through the block into the metal strip with the washer 64 under the head of the screw on top of the wire mesh, as illustrated in FIG. 4. The spacer block 62 may for convenience be formed of the same material as the core.

The purpose of the wire mesh 61 is to provide an apertured surface for holding concrete applied to the front face of the panel and for then comprising reinforcing bar in such concrete. For this purpose the depth of the spacer blocks may be of the order of one inch when a 3 inch concrete coating is to be applied. Generally in practice a plurality of panels in accordance herewith are joined together to form the shape of the desired structure and then the concrete is applied to the outer surface so that, upon hardening, the concrete forms a rigid wall or the like attached to the combination of panels. The panels in this application will be seen to comprise somewhat of a form for a concrete wall which may, for example, be applied by commercially available concrete spraying equipment or by hand; however, the panels of the present invention remain as a portion of the wall and, in fact, provide a high degree of insulation thereto.

Figure 5:
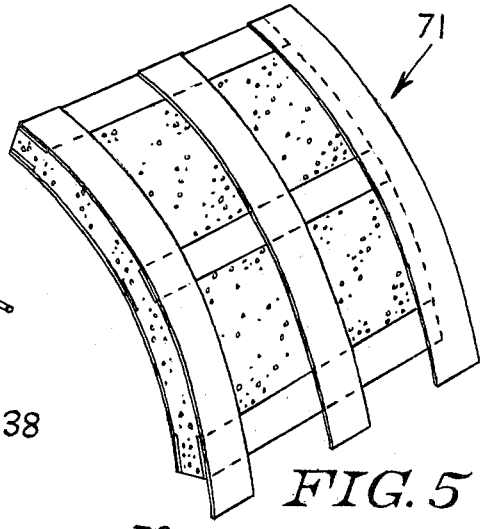
FIGS. 5, 6 and 7 are perspective illustrations of various panel shapes.
Figure 6:
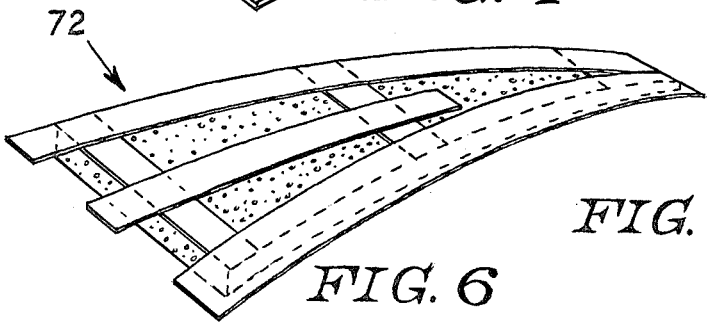
Figure 7:
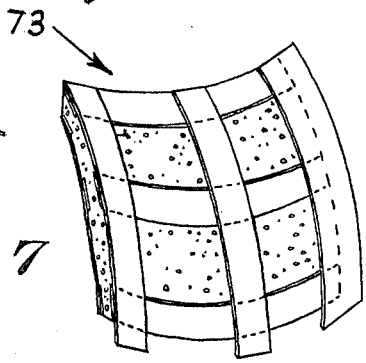
Figure 8:
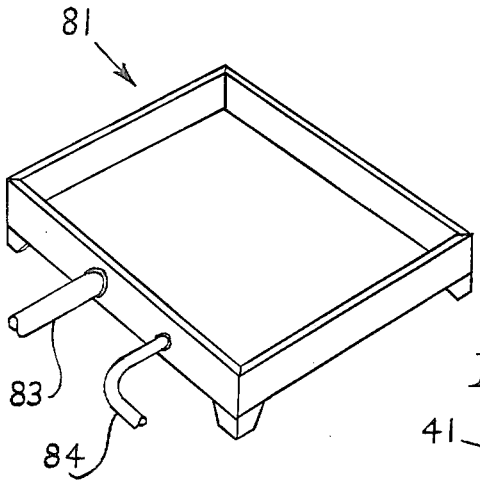
FIGS. 8 and 8A are perspective illustrations of a core mold and mold top, respectively, as may be employed in carrying out the method of the present invention.
Figure 8A:
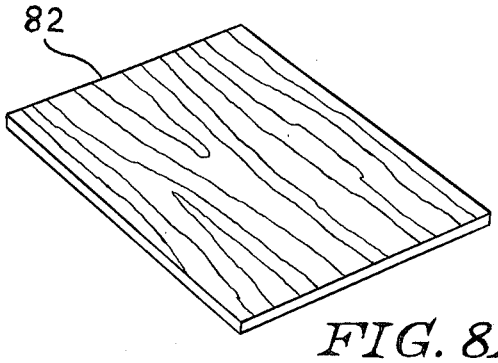
Figure 9:
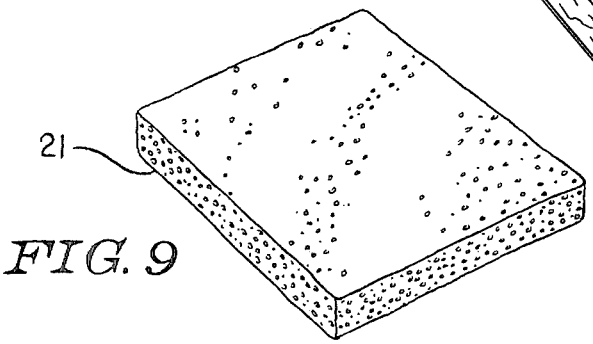
FIG. 9 is a perspective illustration of a mold core in accordance with the present invention.
Figure 10:
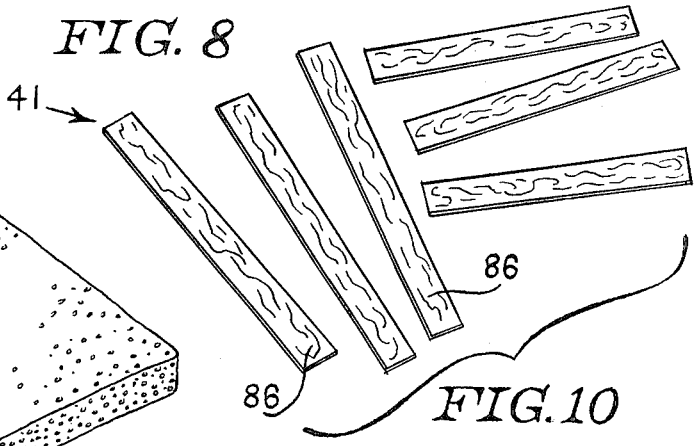
FIG. 10 illustrates a plurality of thin reinforcing strips as employed in the method hereof to form the panel of this invention.

As noted above, the panels of the present invention may be formed in a variety of configurations and the planar rectangular configuration of FIG. 1, for example, is shown for ease of description. In FIGS. 5, 6 and 7 there are illustrated possible alternative panel configurations. In FIG. 5 there is illustrated a panel 71 having a generally rectangular outline but having a curved rather than planar configuration. In FIG. 6 there is illustrated a triangular shaped panel 72 also formed as a curved surface. In FIG. 7 there is illustrated a panel 73 having a curvature in two mutually perpendicular directions. It will be seen that the panels of FIGS. 5, 6 and 7 are each formed in accordance with the present invention as described above and panels of these shapes are particularly adapted in multiple combinations to form semispherical surfaces which have maximum strength for exterior loading as by the application of concrete thereto. It is also noted that the panels of FIGS. 5, 6 and 7 are illustrated without the wire mesh thereon; however, it will be appreciated that mesh is attached thereto, as described above, for applications of the panels wherein a coating such as concrete is to be applied to the panels' surfaces.

It would, of course, also be possible to mount a wire mesh on the rear or back surface of the panel; however, such is normally not necessary unless it should be desired to have a double concrete wall. Alternative coatings or the like may be applied to the back surface of the panel if desired and, for this purpose, the back surface of the panel may be treated to improve adherence of such a coating. Thus, for example, if a plaster is to be applied to the back surface of the panels, the core surface may be roughened or degraded as described below and similarly the thin metal strips may be roughened as by the application of some type of roughening agent such as an adhesive or the like thereto.

The present invention also includes the method of manufacture of the panel or panels described above. This method is advantageous in providing panels of substantially any desired configuration by molding of the panel core and produces panels having close dimensional tolerances. The method of the present invention is illustrated in FIGS. 8 through 15 with regard to the manufacture of a rectangular planar panel merely for ease of illustration, for the same process is applicable to the formation of alternatively shaped panels, such as those illustrated, for example, in FIGS. 5 through 7.

The core 21 of the present invention is formed in accordance herewith by molding. This molding is carried out in a mold such as that illustrated at 81 of FIG. 8 and having a top 82 for closing the mold. Normally the mold parts are mounted in equipment which moves them together and apart as required during processing, although such is not shown in the drawings. The interior of the mold 81 is shown to have a rectangular configuration of the dimensions of the resultant panel and a depth of such a panel. With the mold closed, i.e., the top 82 applied to the bottom portion of the mold 81, material is inserted in the mold through a pipe or the like 83 extending through a side of the mold. Considering now that the core is to be formed of expanded polystyrene, the mold is filled with small beads of expandable polystyrene and these beads are chosen to produce the core density desired. The beads may be aspirated into the closed mold as by drawing a vacuum in the mold until the mold is filled. The polystyrene in the mold is then expanded by the application of heat. Heat may be applied in a variety of ways; however, the convenient and conventional manner is to inject steam into the mold and for this purpose a steam line 84 is shown to extend through a mold wall. In practice steam may be injected in a substantial number of places in order to ensure an even dispersion of heat in the material in the mold. With the application of heat the beads of polystyrene expand to fill the mold and adhere to each other to form the core 21. Molding of polystyrene, for example, is well known in the art and thus only the general steps are described herein.

After the core is molded it is removed from the mold and reinforcing strips are placed on the front and back surfaces of the core. These strips are placed at least along the edges of the front and back surfaces and may be temporarily attached to the core in a variety of ways. For example, the core may be molded with small aligning bumps on the front and back surfaces and metal strips, for example, placed with the edges thereof against these bumps and pressed into them to temporarily hold the strips in place. Other alternatives include cleats on the strips to grip the core, openings in the strips to grip bumps or projections on the core or adhesive on the strips. Between the core and strips there is provided a heat activatable adhesive which may be of conventional composition.

Figure 11:
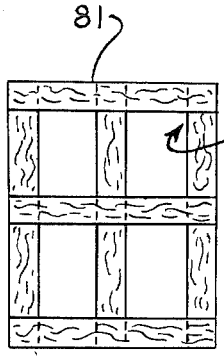
FIG. 11 is a back elevational view of a panel core with reinforcing strips arranged thereon.
Figure 12:
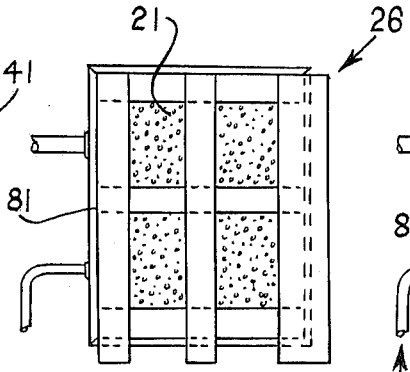
FIG. 12 is a plan view of an open mold containing a core having reinforcing strips arranged on front and back surfaces thereof.
Figure 13:
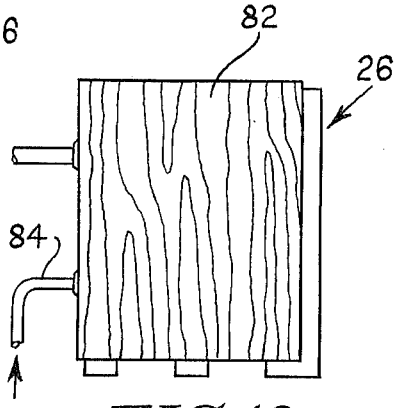
FIG. 13 is a plan view of the mold in closed position for bonding the reinforcing strips to the core.
Figure 14:
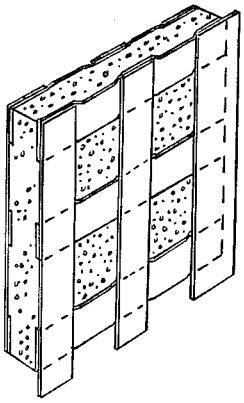
FIG. 14 is a perspective view of a panel formed in accordance with the method of the present invention.

Reinforcing strips 41 are placed on the back surface of the core 21 as indicated in FIG. 11 and reinforcing strips 26 are placed on the front surface of the core as indicated in FIG. 12. The front strips 26 are disposed with tabs 51 thereof extending from the bottom edge of the core and with the strip 37 along the right edge of the core overhanging the edge. The core with the strips thereon is replaced in the mold and the mold top is replaced. The side strip 37 and tabs 51 extend over the sides of the mold as shown in FIGS. 12 and 13. Heat is again applied to the mold, as by injecting steam therein through the pipe 84, to bond the strips to the core by activating the adhesive. It is furthermore noted that when the core 21 is originally removed from the mold and cools, it will shrink. This is an almost unavoidable consequence of casting expanded polystyrene, for example. While it is possible to estimate the amount of shrinkage and make the mold oversized by this amount, it will be appreciated that such an approach is only an approximation. The present invention, on the other hand, provides for re-expansion of the core during the second heating cycle wherein the core and strips are inserted in the mold. As the core is re-expanded to completely fill the mold, adherence of the core to the metal strips along the edges of the core prevents subsequent contraction of the core so that, when the core and strips illustrated in FIG. 14 are removed from the mold, the external dimensions of the core are the same as the internal dimensions of the mold. The present invention thus provides for attaining dimensional stability in the casting of the expanded plastic core. A cast expanded polystyrene core, for example, will eventually lose the capability of re-expanding if it is stored for an extended period of time before reinsertion in the mold for bonding of the metal strips thereto. Thus it is necessary for the process of the present invention to be carried out in an orderly manner whereby the capability of the core to re-expand is employed.

The above-described process of forming the core with reinforcing strips bonded thereto may be modified in various ways. Thus, for example, it is possible to position the reinforcing strips in a mold, inject an expandable plastic and add heat to form the panel. Bonding of the core and strips may also be accomplished mechanically as well as chemically as by forming the strips in such a manner that they are mechanically gripped by the expanded plastic.

Figure 15:
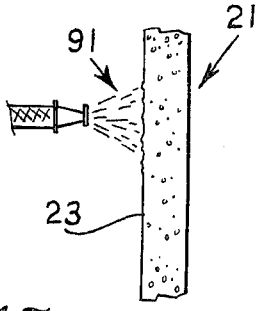
FIG. 15 is a partial sectional view of a panel undergoing degrading of the rear surface thereof.

The application of wire mesh to the front surface of the panel has been described above and may be readily accomplished by attachment thereto with sheet metal screws, for example. It was also noted above that under some circumstances a coating of a material such as plaster may be applied to the back surface of panels of the present invention. Under these circumstances it is advantageous to provide such surface with advantageous characteristics for receiving and retaining such a coating. The cast surfaces of the core 21 are relatively smooth and the adherence of plaster or the like thereto may be greatly improved by "degrading" the rear surface of the core. This may be advantageously accomplished by lightly spraying a solvent on the back surface of the core, as generally illustrated in FIG. 15. As small droplets of a suitable solvent are applied as by a spray 91 to the vertical core surface 23, these droplets will dissolve core material. It will be recalled that the core has been cast by expanding tiny beads of polystyrene, for example, and thus the core density actually decreases from each original bead center to the contact with the next bead and then increases back to the adjacent bead center. The solvent consequently acts primarily between original bead centers to dissolve material and it has been found that spraying of a solvent on a vertical surface of the cast core produces very irregularly constituted small openings in the core which tend to extend downwardly and inwardly of the core from the surface. These indentations or small cavities are admirably suited to receive a coating such as plaster which then flows into the cavities and securely locks the coating onto the core. It is noted that the illustration of FIG. 15 does not attempt to show the strips on the core; however, the degrading of the core surface is accomplished after the strips are applied. Inasmuch as the reinforcing strips may be quite smooth, it is also preferable to apply some type of roughening agent to the strips prior to the application of a coating such as plaster. Various types of materials are suitable for this such as, for example, some type of an adhesive material which sticks tightly to the outer surface of the strips but is not smooth.

There has been described above an improved composite panel structure that is lightweight, inexpensive and has extremely good insulating properties. The panel structure is primarily intended for utilization with exterior coatings; however, such is not absolutely necessary. The application of wire mesh to the front surface of a panel in accordance with this invention provides an improved panel particularly adapted to receive concrete coating.

The present invention as to panel structure and method of manufacture has been set forth above with respect to particular preferred embodiments of the panel and steps of manufacture; however, it will be appreciated by those skilled in the art that modifications and variations thereof are possible within the scope of the present invention. It is not intended to limit the present invention to the precise terms of description nor details of illustration.

What is claimed is:

1. A composite building panel comprising a core element consisting of rigid expanded plastic material having a front and back surface, and a plurality of thin reinforcing strips bonded during expansion of said plastic material to each of said front and back surfaces of said core with a strip extending at least along each of the edges of said surfaces and extending laterally from only first and second adjacent edges of said core only on the front face thereof.

2. A composite building panel comprising a core element of rigid expanded plastic material having a front and back surface, a plurality of thin reinforcing strips bonded to each of said front and back surfaces of said core and extending at least along all of the edges of said surfaces and extending laterally from only first and second adjacent edges of said front surface of said core, and a wire mesh mounted upon the front surface of said panel in uniform spaced relation thereto and coextensive therewith.

3. The panel of claim 1 further defined by said thin reinforcing strips being bonded to said core element by an adhesive.

4. The panel of claim 1 further defined by said core comprising expanded polystyrene having a density in the range of one pound per cubic foot to six pounds per cubic foot.

5. A composite panel comprising a core element of expanded polystyrene having substantially parallel front and back surfaces, a first plurality of thin reinforcing strips bonded to the front surfaces of said core at least along the edges thereof, at least one of said strips extending laterally of said core at a first edge thereof and at least one of said strips extending laterally of said core at a second edge thereof adjacent said first edge, a second plurality of thin reinforcing strips bonded to the back surface of said core at least along the edges thereof, and a wire mesh mounted upon the front surface of said panel in spaced relation thereto and extending to the edges of said front face, and the back surface of said core having small cavities therein.

* * * * *